US005199848A

United States Patent [19]

Kapich

[11] Patent Number: 5,199,848

[45] Date of Patent: Apr. 6, 1993

[54] PORTABLE WATER DRIVEN PUMP

[76] Inventor: Davorin Kapich, 3111 Serrano Dr., Carlsbad, Calif. 92009

[21] Appl. No.: 890,375

[22] Filed: May 26, 1992

Related U.S. Application Data

[63] Continuation of Ser. No. 606,868, Oct. 31, 1990, abandoned.

[51] Int. Cl.[5] ..... F01D 9/02

[52] U.S. Cl. ..... 415/202; 415/912; 417/408

[58] Field of Search ..... 415/202, 912, 110, 111; 417/406–409

[56] References Cited

U.S. PATENT DOCUMENTS

| | | | |
|---|---|---|---|
| 1,172,436 | 2/1916 | Coppus | 417/408 |
| 2,219,937 | 10/1940 | Ponomareff | 417/408 |
| 3,607,779 | 9/1971 | King | 261/24 |
| 4,097,188 | 6/1978 | Forster | 415/202 |
| 5,013,214 | 5/1991 | Kapich | 415/202 |

FOREIGN PATENT DOCUMENTS

| | | | |
|---|---|---|---|
| 2519095 | 7/1983 | France | 415/110 |
| 1302027 | 4/1987 | U.S.S.R. | 415/111 |
| 1525330 | 11/1989 | U.S.S.R. | 415/111 |

*Primary Examiner*—John T. Kwon
*Attorney, Agent, or Firm*—John R. Ross

[57] ABSTRACT

A compact water turbine driven water pump comprising an impeller driven by an axial flow water turbine wheel both operating on a single shaft and contained in a housing. A nozzle body also contained in the housing comprises a plurality of nozzles through which water is discharged to imping on the blades of the turbine wheel which is full submerged in water. The nozzles are cylindrical or part conical and part cyndrical and the centerline of the nozzles form an angle of about 10 to 30 degrees with the outlet surface of the nozzle body. A manufacturing method is provided which permits the manufacture of pumps of various power using the same standard machined parts.

7 Claims, 6 Drawing Sheets

PORTABLE WATER DRIVEN PUMP

BACKGROUND OF THE INVENTION

This is a continuation of application Ser. No. 07/606,868 now abandoned.

This invention relates to water turbine driven water pumps and in particular to light weight, high capacity, portable pumps.

Removal of water or other fluids from the inside of damaged ships, underground channels and mine shafts often requires that the fluid be lifted to heights which are beyond the physical limitations of pump suction capabilities.

In such cases, the pump has to be lowered to relatively low heights above the water level. Submerged electric driven pumps, commonly known as well pumps are available. In some situations a jet pump is suspended by pipes or water hoses below the water level to prime a main pump above. This arrangement has two shortcomings. First, the jet pumps are very limited in the height of water they can deliver, while entraining reasonable amounts of secondary water. Second, the jet pumps suffer relatively low hydraulic efficiencies.

It is an objective of the present invention to provide a water turbine driven pump which has high flow and high head capability and is light weight.

A further objective is to provide a pump which can be manually lowered substantial distances into a fluid and provide priming water to another pump located at a higher elevation.

It is another objective of this invention to provide a pump capable of pumping substantially larger water flows than the turbine flow, so it could be utilized as a relatively high efficiency flow multiplier.

It is a further objective that the pump be capable of operating with fluids such as flamable fluids without substantial danger of initiating as explosion.

SUMMARY OF THE INVENTION

The present invention provides a compact water turbine driven water pump comprising a liquid pump driven by an axial flow water turbine wheel both operating on a single shaft and contained in a housing. A nozzle body also contained in the housing comprises a plurality of nozzles through which driving water is discharged to imping on the blades of the turbine wheel which is fully submerged in the driving water. The nozzles are cylindrical or part conical and part cyndrical and the centerline of the nozzles form an angle of about 10 to 30 degrees with the outlet surface of the nozzle body. A manufacturing method is provided which permits the manufacture of pumps of various power using the same standard machined parts.

DETAILED DESCRIPTION OF PREFERRED EMBODIMENTS

Figure 1:
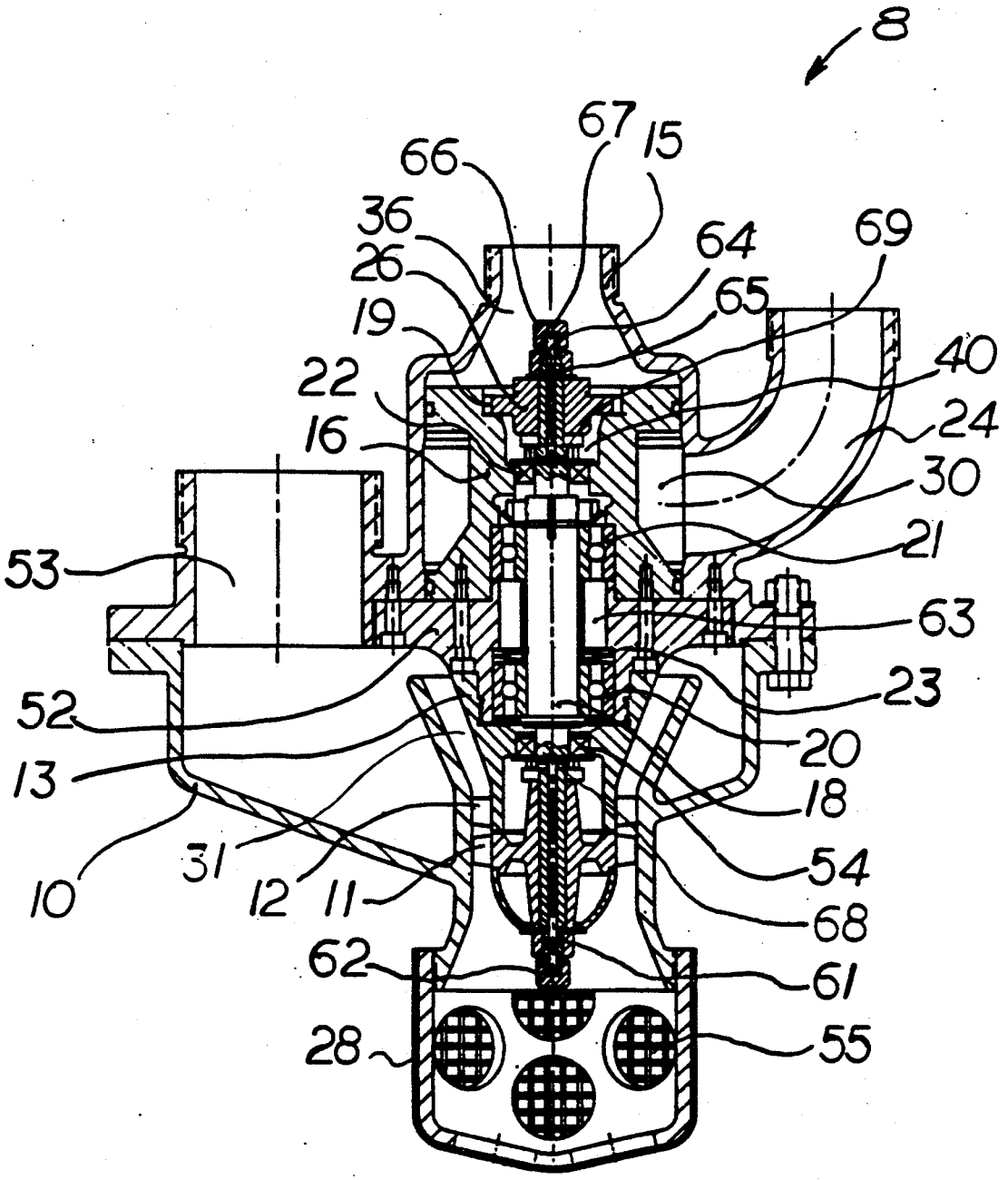
FIGS. 1 and 2 are sectional views in as axial plane of the pump incorporation this invention and showing two preferred lubrication methods.

The novel water driven water pump in its preferred embodiment provides 250 gallons per minute (GPM) water flow with 80 feet water gage pressure rise, while being driven by a water turbine producing 6.5 horsepower at 11,000 RPM and having the turbine wheel diameter of only 2 inches. The overall weight of the novel pump unit is approximately 28 pounds, thus making it easily transportable by a single person.

With particular reference to FIGS. 1, 2, 3, 4 and 8, a water turbine driven pump incorporating the principles of the present invention is generally indicated by reference to numeral 8. Such pump includes pump housing 10 which is solidly connected to the pump center body 13 via multiple pump stator vanes 12. The center body 13 contains rolling element bearings 20 while the turbine nozzle body 16 centrally positioned and firmly attached to the center body 13 contains rolling element bearing 21. Said bearings provide for rotatable radial and axial support to the shaft 18 which at its front end supports a firmly attached axial flow bladed liquid pump impeller 11 and which at its rear end supports a firmly attached axial flow bladed water turbine wheel 26 incorporating turbine blades 19. Since the turbine wheel 26 is water driven, a conventional type sliding shaft seal 22 is provided sealing the water filled cavity 40 from the oil filled cavity 63 located on the opposite side of the seal 22. Bearings 20 and 21 are fully submerged in oil which completely fills the cavity 63.

Sliding shaft seal 54 seals the oil cavity 63 from the water present around pump impeller 11. FIG. 1 shows an arrangement where the turbine discharge cavity 36 is communicating with shaft passage 64 through hole 67 located in the nut 66. Therefore, the pressure in cavity 36 exerts pressure on plunger 65 which is free to move axially in hole 64. Plunger 65 transmits the pressure from hole 64 containing water to the other side of plunger 65 which is in communication with oil filled cavity 63 via radial holes 69. Plunger 65 is close fit in hole 64 and sealed with a seal such as a small O-ring or similar seal (not shown) to prevent leakage of oil into water and vice versa.

On the other end of the shaft, radial holes 68 connect passage 61 with cavity 63. Nut 62 seals passage 61 from water surrounding impeller 11. With this arrangement the pressure in cavity 63 is essentially balanced with the pressure incavity 40, thus minimizing the pressure differential across sliding seal 22. (Pressure drop across blades 19 is very small.) Any expansion or contraction of oil due to increasing or decreasing temperature in the oil cavity 63 is accomodated by axial motion of plunger 65.

Figure 2:
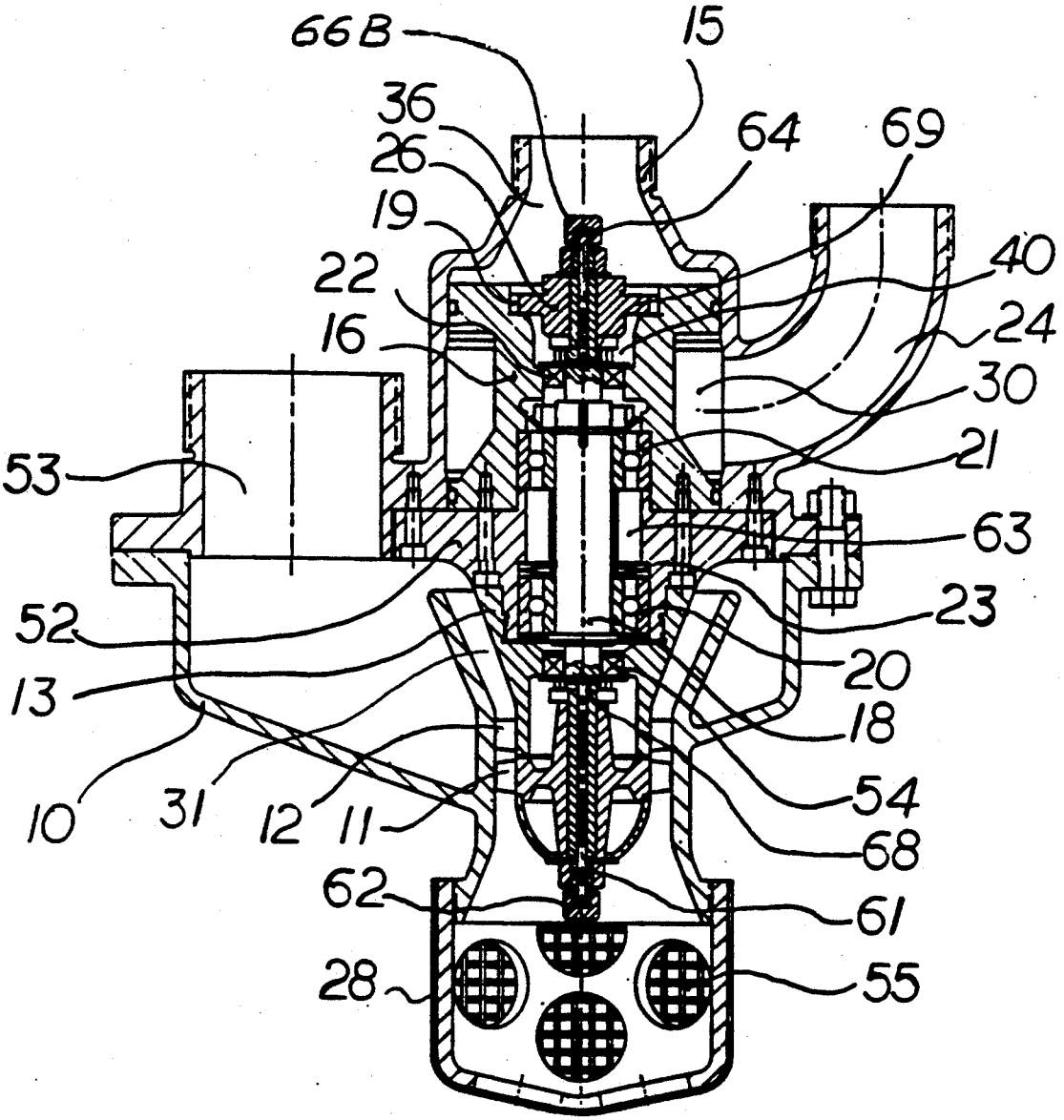

FIG. 2 shows a similar arrangement as in FIG. 1, except it has no plunger and nut 66B has no hole in it as did nut 66. Oil is essentially contained in cavity 63 between sliding seals 22 and 54 and nuts 66B and 62.

Figure 8:
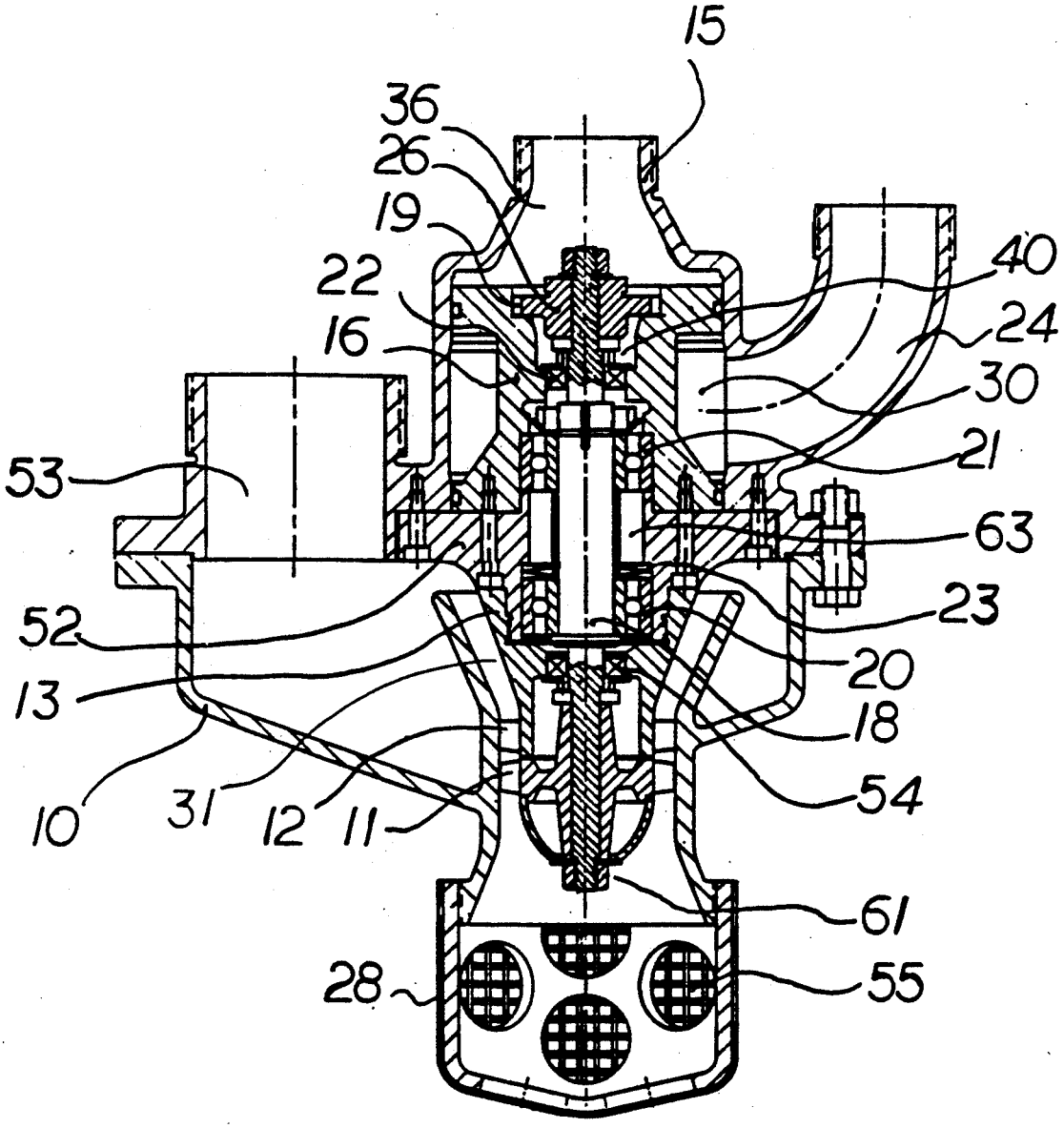
FIG. 8 is a sectional view of the pump showing a third preferred lubrication method.

FIG. 8 shows an arrangement without any holes in the shaft with oil contained in cavity 63, only by sliding seals 22 and 54.

Persons skilled in this art will recognise that other bearing systems such as water lubricated bearings or oil lubricated journal bearings can be utilized.

Cooling to the sliding seal 22 is substantially provided by the water which during the turbine operation inevitably circulates through cavity 40. Cooling to bearing 21 is provided substantially by water flow through turbine inlet cavity 30 while cooling to bearing 20 is provided mainly by water flowing through pump blades 11 and stator vanes 12. Axial spring 23 provides for a substantially constant axial load on the front bearing 20 for purpose of constant angular contact between the bearing balls and the races, thus providing for a more central shaft location at all operating conditions.

My 6.5 horsepower design comprises 16 impeller blades 11 utilizing standard NACA 65 series airfoils mounted in accordance with standard design practice. The water flow into the pump enters through the protective screen 28 and holes 55 into impeller blades 11 which pump the water further through stator vanes 12 and into difussor section 31. The water flow further passes through cylindrical flange 53 which is sized to accomodate standard 2½ inch diameter water hose.

The water flow is supplied to the water turbine at a pressure ranging typically from 100 to 250 PSIG into the annular water turbine inlet cavity 30 through the pipe elbow 24.

Pipe elbow 24 may typically be arranged to swivel around in various directions and have provision to be connected to a standard 1.50 inch or 1¾ inch fire hose which is not shown. The annular water turbine inlet cavity 30 supplies the high pressure water to a plurality (twelve in this embodiment) of turbine nozzles configured as round holes with generally varying diameter and positioned apropriately within the nozzles body 16, so as to produce maximum hydraulic efficiency in combination with the turbine wheel blades 19. Such turbine nozzles are indentified as numeral 50 in the FIG. 3 and FIG. 4.

Figure 4:
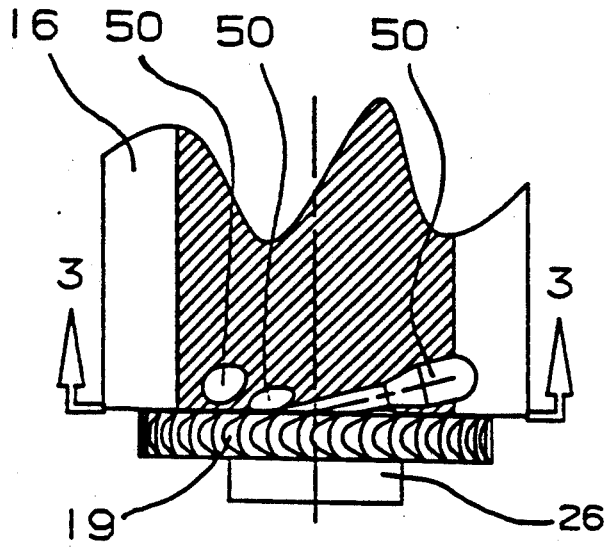
FIG. 4 is a sectional view along the line 4—4 of FIG. 3 showing also the position of turbine blades relative to the nozzle passages.
Figure 3:
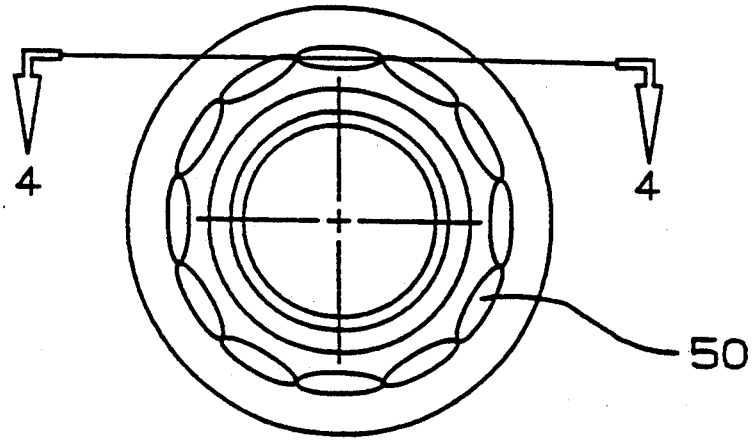
FIG. 3 is a view of the nozzle body incorporating the nozzle passages.

As indicated in FIG. 3 and FIG. 4, the turbine nozzles are drilled at an angle of about 10 to 30 degrees with the plane of the face of the nozzle body outlet surface. In my prototype designed for 4 to 8 horsepower the angle was 15 degrees. At these angles the nozzles form openings in the slope of ovals as shown in FIG. 3 and FIG. 4. The ovals are essentially contigous in my preferred embodiment where I have twelve nozzles. As shown in FIG. 4 the shape of the perimeter of the nozzles 50 are cylindrical, conical and cylindrical going from the cavity to the outlet surface.

As indicated above a nozzle angle of 15 degrees works well for 4 to 8 horsepower at about 200 PSI turbine inlet pressure and a design speed of about 11,000 RPM. For fans designed for power outputs of less than 4 HP or greater than 8 HP or for substantially different rotational speeds it may be desirable to change the angle slightly using techniques developed for gas turbine design. It is unlikely that the angle would need to be greater than 30 degrees or less than 10 degrees.

FIG. 3 shows the plane view of the exit portion of turbine nozzles 50 as viewed in the plane 3—3 in FIG. 4. The FIG. 4 shows a section through the nozzles body 16 along the plane 4—4 in FIG. 3 and combines such view with the plane view of turbine blades 19 and the turbine wheel 26. The high pressure water is fed from the annular water turbine inlet cavity 30 into the plurality of turbine nozzles 50. The water flow further accelerates through the nozzles 50 converting the pressure energy into the kinetic energy with minimum hydraulic losses.

The high hydrodynamic efficiency of nozzles 50 is attributed to the particular combination of round cross sectioned nozzles 50 and the gradual change in the cross section of the flow area along the centerline axis of the individual nozzles 50. The turbine nozzles 50 are positioned relatively to each other within the nozzles body 16 so as to produce minimum wakes of low velocity fluid in between the passage areas of nozzles 50 and the turbine blades 19. Such wakes are considered to be generally harmful to the turbine hydraulic efficiency. Such nozzles positioning as shown on FIGS. 3, 4, 5A, 6A, 5B and 6B maximizes the percentage of the turbine blades frontal flow area occupied by the high velocity fluid relative to the frontal flow area occupied by the wakes. The relatively high velocity water entering the turbine blades 19 produces work in the blades 19 which are as aforesaid driving the pump impeller 11 via the turbine wheel 26 and the shaft 18. The water flow exits the turbine blades 19 into the passage 36 and via housing exit 15 which may be connected to standard size fire hose in a similar fashion as the inlet pipe elbow 24. Lower power pumps could be configured to be connected to standard water hose connections.

A alternate turbine nozzles and turbine wheel configurations, producing significantly higher shaft horsepower and utilizing the same basic turbine hardware as described before is shown on FIGS. 5B, 6B and 7B. The lower horsepower turbine nozzles configuration shown on FIGS. 5A and 6A incorporates nozzle body 16A and individual nozzles 50A having exit diameter indentified as NA on FIG. 5A. The matching lower horsepower turbine wheel and the turbine blades are indentified by a numerals 26A and 19A respectively, on the FIG. 7A. The tip diameter of the lower horsepower turbine blades is indentified as DA on FIG. 7A. The basic turbine blades configuration diameter indentified as DB on FIG. 7A is generally larger than the diameter DA and is being machined down to the diameter DA for a lower power version, while it can remain unchanged for a higher power version such as shown on FIG. 7B.

Figure 5A:
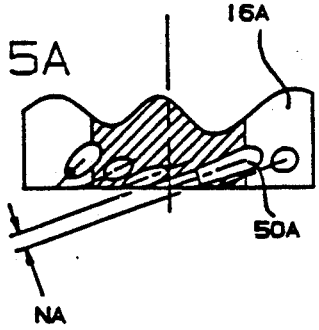
FIG. 5A is a sectional view along the line 5A—5A of FIG. 6A of a nozzle passage for a relatively lower horsepower configuration turbine.
Figure 5B:
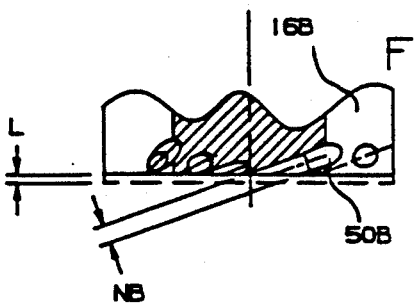
FIG. 5B is a sectional view along the line 5B—5B of FIG. 6B of a nozzle passage for a relatively higher horsepower configuration turbine.
Figure 6A:
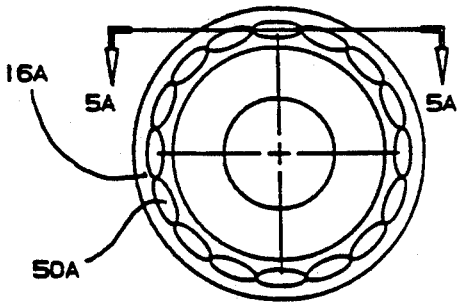
FIG. 6A is a view of the nozzle body for a relatively lower horsepower configuration turbine.
Figure 6B:
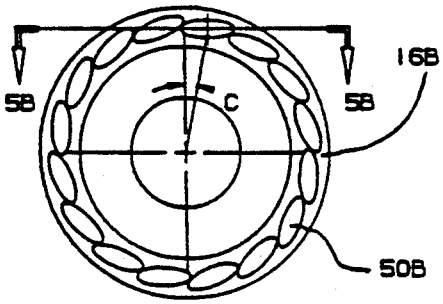
FIG. 6B is a view of the nozzle body for a relatively higher horsepower configuration turbine.
Figure 7A:
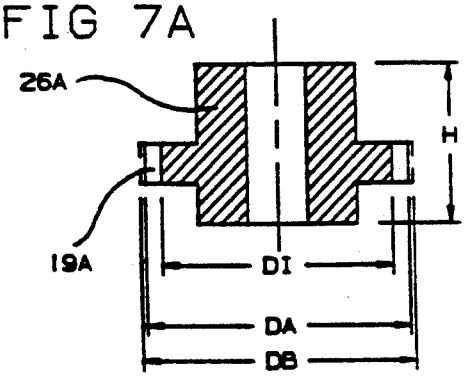
FIG. 7A is a sectional view of the turbine wheel for a relatively lower horsepower configuration turbine.
Figure 7B:
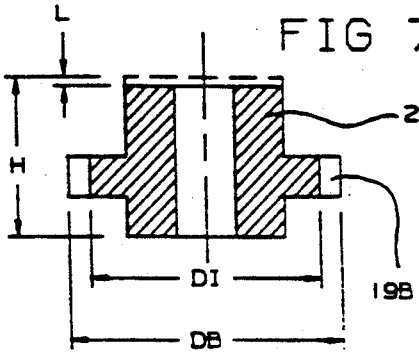
FIG. 7B is a sectional view of the turbine wheel for a relatively higher horsepower configuration turbine.

The basic nozzles body utilized for both versions is shown on FIGS. 5A and 6A and it can remain unchanged for the lower power version. For the higher power version the cylindrical portion of the individual nozzles diameter is being increased from the dimension NA shown on FIG. 5A to a dimension NB shown on FIG. 5B while utilizing the same centerlines of the individual nozzles. As described earlier the typical nozzle passage geometry such as shown as 50A on FIG. 5A, consists of tapered hole at the entrance and leading into a cylindrical portion of the nozzle passages closely adjacent to each other at the nozzle exits. Therefore, an increase of individual nozzles diameters in those region will cause interference of those passages and resulting in a breakage between the nozzle walls. To correct this undesirable effect, the nozzle body is machined in the axial direction by the amount shown as dimension L on FIG. 5B. The result of the aforementioned operation will produce closely nested nozzles with larger flow areas such as indicated by the numeral 50B on FIG. 6B. The turbine blades tip diameter indentified as DB on FIG. 7B is sized to match the larger nozzles shown on FIG. 6B. The objective of this design method is to affect minimum changes in the overall turbine and fan configuration, thus the position of bearings and the shaft remain unchanged for both versions. This dictates that the turbine wheel be machined in the axial direction by the dimension L shown on FIG. 7B, in order to compensate for the aforementioned change of the nozzles body shown as dimension L on FIG. 5B. The increase in the nozzle sizes utilizing the aforementioned procedure such as shown on FIG. 6A with smaller nozzles to a FIG. 6B with larger nozzles, changes the outer perimeter of the nozzle exits significantly, thus requiring a change in the matching turbine blades tip diameter from DA shown on FIG. 7A to a diameter DB on FIG. 7B. However, the change of the inner perimeter of the nozzle exits is minimal because of the compound effect of the nozzles centerline spreading further apart form each other tending to increase the inner perimeter of the nozzles, while the increase in the individual nozzles diameter tends to decrease the inner perimeter of the nozzles. For typical high efficiency turbines, the nozzles centerlines are positioned to the shaft centerline with an angle of 60 to 80 degrees (10 to 30 degrees with the turbine nozzle outlet surface) which in combination with an appropriate cone shape of individual nozzles allows for maintaining of relatively constant inner nozzles perimeter utilizing the above described procedure. Therefore, the turbine blades inner diameter shown as DI on FIGS. 7A and 7B which typically is somewhat smaller than the inner perimeter of the nozzles, can remain the same for both versions even if the inner perimeter of the nozzles changes slightly from one version to another. By this method, a relatively simple and inexpensive machining operations allow for utilization of standard premachined turbine nozzles bodies and premachined turbine wheels and blades, thus avoiding a relatively large expense associated with redesigning and retooling of the entire turbine and associated housings.

The higher turbine power output achieved by the above described method is matched by the same increase in power absorbed by the pump. Standard methods, such as slight increase of pump tip diameter or adjustment in the pump blade angles or change in number of pump blades can be utilized to produce desired pump performance.

Figure 9:
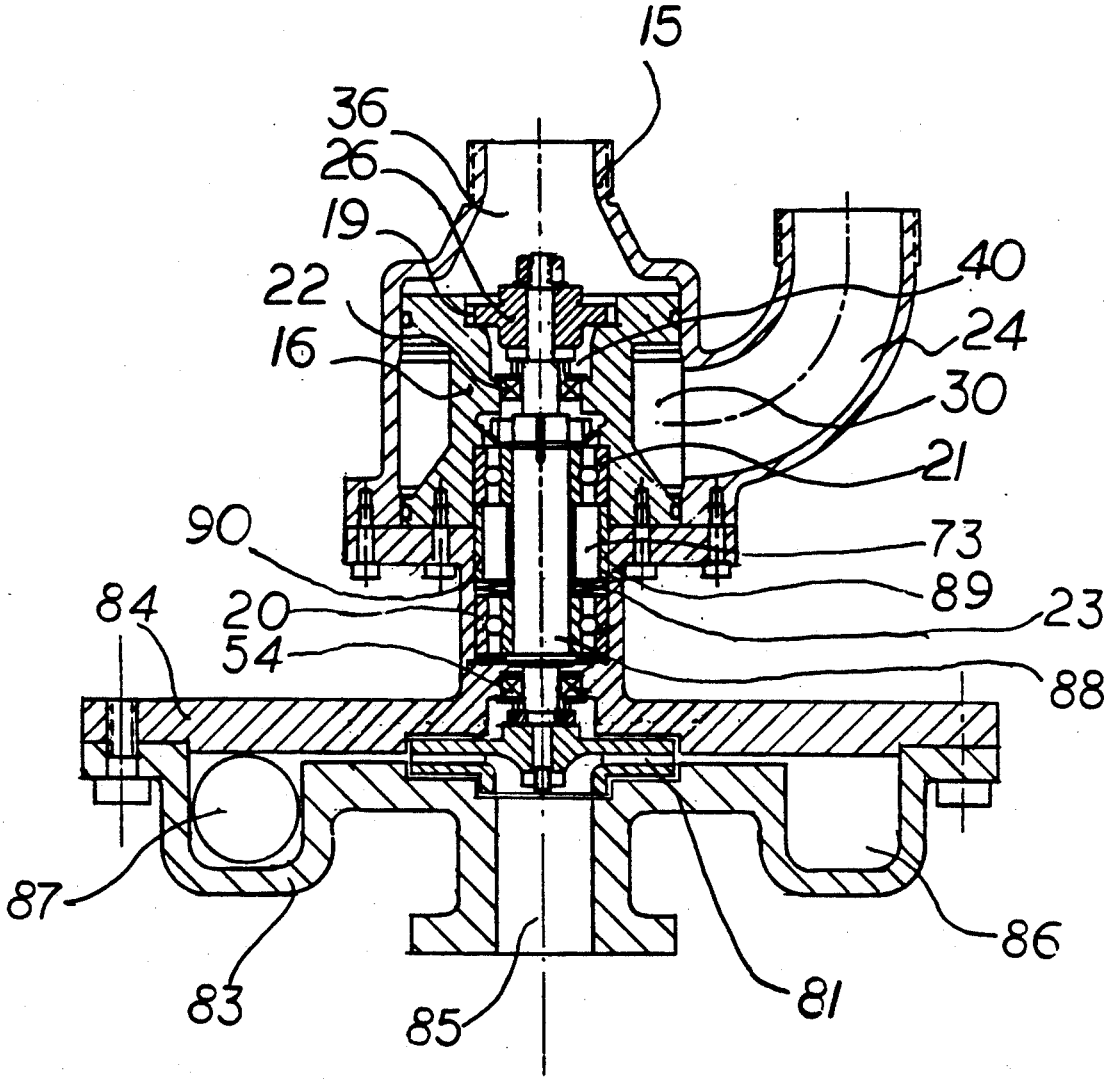
FIG. 9 is a sectional view showing an embodiment using a centrifugal pump.

FIG. 9 shows a centrifugal flow pump driven by the novel turbine. This embodiment covers applications requiring high heads and low flows. A typical applications for example might be for pumping of 30 gallons per minute of fire fighting foam concentrate liquid up to 150 psig pump discharge pressure. The foam concentrate is then mixed with a relatively large flow volume of water which would be supplied by a separate pump. The mixture of foam concentrate and water is then expanded through a fire fighting nozzle down to atmospheric pressure where it forms large volumes of foam for purpose of isolating the source of fire from the atmospheric air.

In this preferred embodiment, the centrifugal pump impeller 81 is driven by turbine wheel 26 through shaft 88 supported by bearings 20 and 21. Bearing 20 and shaft seal 54 are supported by bearing housing 84 which is attached solidly to the water turbine housing 15 and nozzle body 16. The pump housing 83 is attached solidly to bearing housing 84. The fluid being pumped enters pump housing 83 via pump inlet 85 and into the centrifugal pump impeller 81, which pumps the fluid into an annular collection passage 86 and further into discharge passage 87. Bearing cavity 73 is sealed from turbine water with seal 22 and from pumped liquid by seal 54. Cavity 73 is sealed from turbine water with seal 22 and from pumped liquid by seal 54. Cavity 73 is vented to atmosphere through the hole 89 passing through the sleeve 90 and bearing housing 84.

It should be understood that the specific form of the invention illustrated and described herein is intended to be representative only as certain changes may be made therein without departing from the clear teachings of the disclosure. For example, it would be possible to utilize one wide bearing instead of the two spaced bearings as described above.

Accordingly, reference should be made to the following appended claims in determining the full scope of the invention.

I claim:

1. A portable water turbine driven pump for pumping a liquid comprising:

(a) a pump housing;

(b) at least one bearing;

(c) a shaft bearing support means contained in said housing and for supporting said at least one bearing;

(d) a shaft supported by said at least one bearing and defining a shaft axis;

(e) a turbine nozzle body defining a turbine nozzle outlet surface and positioned inside said housing and firmly attached to said housing and comprising a turbine inlet cavity and a plurality of nozzles each of said nozzles providing a passageway for water to pass from said turbine inlet cavity to said turbine outlet surface and defining a nozzle centerline, where each of said nozzle centerlines:

(1) intersect said turbine nozzle outlet surface at points of intersection on a circle defining a nozzle exit circle which circle is concentric about said shaft axis and defines a nozzle exit plane which is perpendicular to said axis and (2) forms an angle of about 10 to 30 degrees whit said nozzle exit plane;

(f) a driving water inlet means for providing driving water under pressure to said cavity;

(g) a liquid pump solidly attached at one end of said shaft, said pump having an inlet port and an outlet port for the passage of said liquid, said outlet port being non-coaxial with said axis;

(h) an axial flow water turbine wheel solidly attached at the other end of said shaft and fully submerged in water having a plurality of turbine blades, said wheel and blades being positioned adjacent to said turbine body outlet surface such that water discharged from said nozzles impinge on said blades.

2. A portable water driven pump as in claim 1 wherein said plurality of nozzles is at least 8.

3. A portable water driven pump as in claim 1 wherein said plurality of nozzles are configured so as to form a set of essentially contiguous ellipses where they intersect said turbine body outlet surface on said exit circle.

4. A portable water driven pump as in claim 1 wherein said turbine blades are configured such that water discharged from said blades at normal operating conditions is directed in a direction parallel to said shaft axis.

5. A portable water driven pump as in claim 1 and further comprising an oil lubrication means for lubricating said bearings.

6. A portable water driven pump as in claim 1 wherein said liquid pump comprises an axial flow bladed liquid pump impeller.

7. A portable water driven pump as in claim 1 wherein said liquid pump comprises a centrifugal pump impeller.

* * * * *